United States Patent [19]

Rydzicki

[11] Patent Number: 4,715,080

[45] **Date of Patent: * Dec. 29, 1987**

[54] BRUSH EXTENSION HANDLE

[76] Inventor: Gregory J. Rydzicki, 130 W. Wilson #5, Orange, Calif. 92667

[ * ] Notice: The portion of the term of this patent subsequent to Jun. 29, 2003 has been disclaimed.

[21] Appl. No.: 716,634

[22] Filed: Mar. 27, 1985

[51] Int. Cl.[4] ..... A46B 5/02

[52] U.S. Cl. ..... 15/146; 15/172

[58] Field of Search ..... 15/144 R, 146, 160, 15/172, 176

[56] References Cited

U.S. PATENT DOCUMENTS

| | | | |
|---|---|---|---|
| 1,194,665 | 8/1916 | Riegger | 15/146 |
| 1,416,081 | 5/1922 | White | 15/146 |
| 2,346,570 | 4/1944 | Francis | 15/146 |
| 3,205,522 | 9/1965 | Then | 15/146 |
| 3,336,617 | 8/1967 | Bosko et al. | 15/146 |

*Primary Examiner*—Peter Feldman

[57] ABSTRACT

This invention relates to an attachment for holding and adjustably positioning a brush. It is substantially provided to be mounted on an extention rod, and enables an operator ease in covering difficult to reach areas.

19 Claims, 20 Drawing Figures

BRUSH EXTENSION HANDLE

BACKGROUND OF THE INVENTION

The need for a brush extention attachment has been recognized for a number of years. For use in painting for example, it enables ease in covering difficult to reach areas without the necessity to climb and carry a ladder. Prior arts issued, so far, relating to this problem, have not been applicable for general, practical use. They failed to fulfill all the necessary requirements, ie., stability of holding a brush in the required position, easy and fast connection and disconnection with a brush, simple and light design of the attachment that is adjustable to existing brushes and applicable to existing extention rods. Besides, in some of prior arts, the brush was clamped to the attachment by threaded means, which is in disagreement with the use of paint because of the paint-drying effect, that plugs grooves of thinner threads.

BRIEF STATEMENT OF THE INVENTION

It is an object of this invention to introduce a new brush extension attachment that avoids insufficiences of prior arts, and has advantages that comply with all the necessary requirements stated in the preceding paragraph. Introduced herein, the invention offers the user even more advantages, that are other objects of this invention. All objects of this invention will become more apparent from this paragraph and the following paragraphs. In the proposed herein attachment, a brush is held by a lower plate and an upper plate with adjustable means. A groove and a bent portion in a lower plate, a bent in an upper plate, and a groove in an adjustable means, being a spring, guarantees stability of holding a variety of brushes between said lower plate and upper plate.

The brush with said lower plate, said upper plate, and adjustable means, can be rotated about the axis of hole in holding arm, and any required position can be clamped by turning clamping lever.

A brush can be inserted in between said lower plate and upper plate after pushing the rear portion of said upper plate down, and the brush is held steadily, between said lower plate and upper plate, thus connected with the attachment, after releasing the rear portion of said upper plate up. The can be taken off, thus disconnected from the attachment, after pushing the rear portion of said upper plate down.

The attachment of the invention is made, for the most part, of light sheet metal, which guarantees its relatively low weight, and requires only simple manufacturing process which reflects on the relatively low cost of this attachment.

The introduced herein attachment of the invention has no threaded parts for clamping a brush, but instead, clamping a brush to the attachment is done by adjustable means, that is a spring means, a lower plate, and an upper plate, that guarantees a large number of repeatability of use of this attachment with a brush. Moreover, the lower plate, and the upper plate, constitute shields against paint that otherwise would be getting on the brush handle during painting.

The introduced herein attachment of the invention can be connected to a standard extension rod.

DETAILED DESCRIPTION

Figure 1:
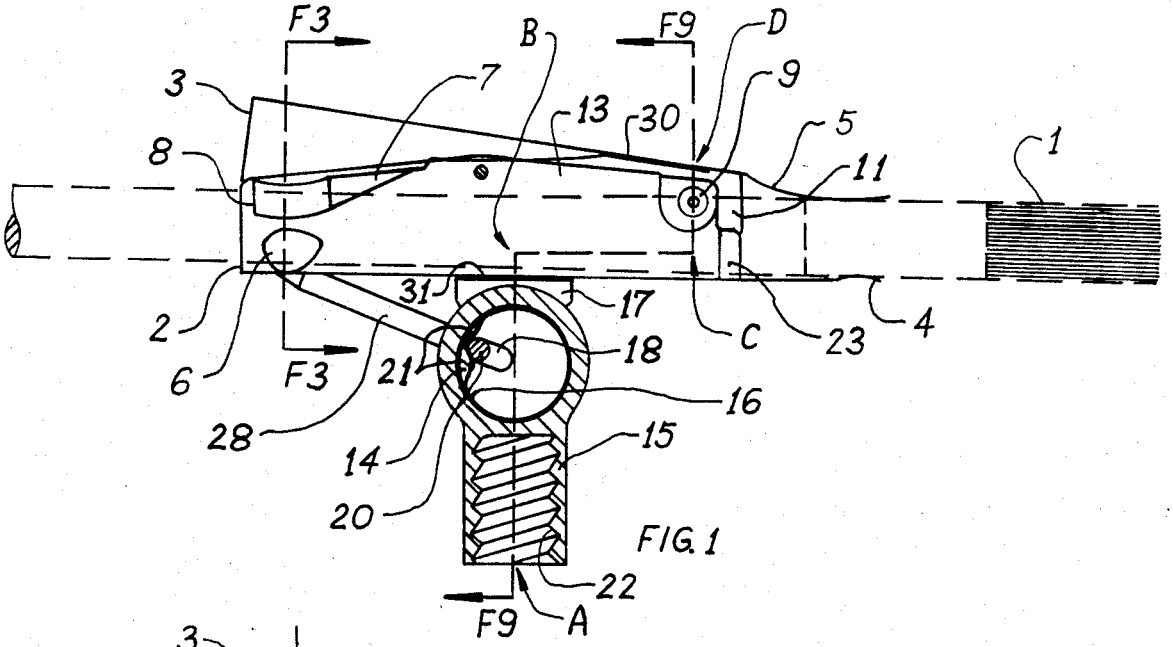
FIG. 1 is an elevational cross sectional view through the center of the attachment. The brush is drawn in dashed lines to show here the space taken by a brush clamped to the attachment, and not any overshadowing clamping means of lower plate and upper plate.

In reference to FIG. 1 wherein brush 1 is held between lower plate 2 and upper plate 3 by means of an upwardly bent arc 4 of the lower plate, downwardly bent arc 5 of an upper plate, adjustable groove 6 of the lower plate, and adjustable means 7. Said adjustable means is substantially regarded as a spring means having adjustable groove 8 for holding variety of brushes, and said adjustable mean is steadily connected to the inside of upper portion 30 of said upper plate. Upper portion 30 is planar in the vicinity to side walls 11 of upper plate. Upper plate 3 is rotationally mounted on the lower plate by two rivets 9 in the front portion of side walls 13 of the lower plate and the side walls 11 of upper plate. The rotational connection of the lower plate and the upper plate by two rivets will become more apparent from FIG. 9. Returning to FIG. 1, the force exerted by adjustable means 7 on the rear portion of brush produces a torque around the rotational axis, formed by said two rivets, thus pushing bent arc 5 down to clamp the brush in the front portion of the attachment. This design guarantees that the brush is held in its front and rear portions by adjustable means, and ensures that the brush is held steadily between said lower plate and upper plate. Besides, the brush is supported in the longitudinal direction by two outwardly running bents 23 in the front portion of side walls 13 of the lower plate. Two of said outwardly running bents 23 can be better visable on FIG. 6. Returning to FIG. 1 wherein the brush clamped between said lower plate and upper plate can be rotated about the center of hole 14 of holding arm 15 due to rotational tube 16, placed rotationally in hole 14. Said rotational tube has two clamping bents 21, that are spring bents, and is steadily connected to the lower plate 2 by means of two side plates 17. The two side plates 17 are steadily mounted to base planar portion 31, of said lower plate in its central portion. Connection of rotational tube 16 with two side plates 17 and lower plate 2 will become more apparent from FIG. 9. Returning to FIG. 1, any rotational position of rotational tube 16, and thus any rotational position of the brush held between said lower plate and upper plate can be clamped by turning clamping lever 18 to the position shown on FIG. 1. Thus, the user can set any required position of brush for ease of painting. When clamping lever 18 is being turned to the clamping position, as shown on FIG. 1, eccentric portion 20, of said clamping lever, is working on two clamping bents 21, of rotational tube 16, and thus it is clamping said rotational tube to the walls of hole 14 of holding arm 15. Said clamping lever can be turned by turning its actuating arm 28. Clamping lever 18 with its eccentric portion 20 is shown on FIG. 19. Returning to FIG. 1, the threaded portion 22, in holding arm 15, is provided for accepting a standard extension rod.

Figure 2:
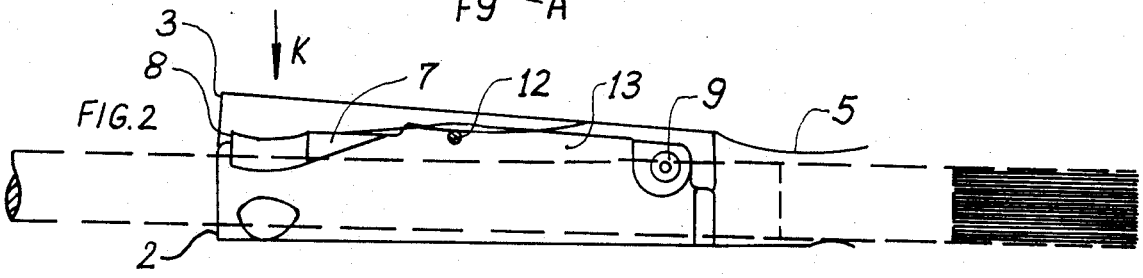
FIG. 2 is an elevational cross sectional view through the center of the upper part of attachment, showing an arrangement when an adjustable means is being supported by a support rod.
Figure 3:
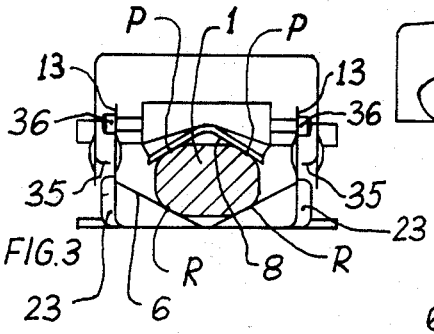
FIG. 3 is a cross sectional view through the rear portion of attachment in plane shown on FIG. 1, and in the direction shown on FIG. 1 by arrows F3.
Figure 4:
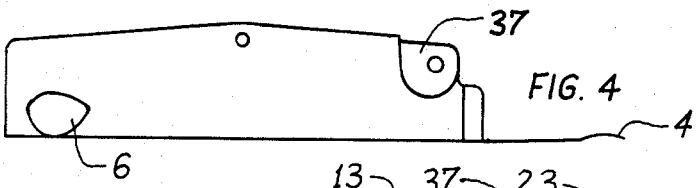
FIG. 4 is a cross sectional view through the center of lower plate.
Figure 5:
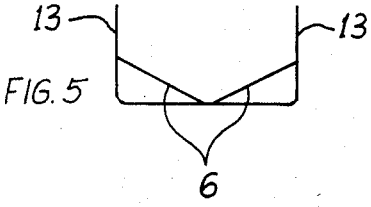
FIG. 5 is a cross sectional view through the rear portion of lower plate.

In reference to FIG. 2 wherein the rear portion of the upper plate is shown pushed downwards, as indicated by arrow K, and thus bent 5 is shown in its upper position due to rotational motion of upper plate 3 about rotational axis formed by two rivets 9, connecting upper plate 3 and lower plate 2. With this position of upper plate 3 in relation to lower plate 2 the adjustable means 7 is supported by support rod 12, mounted steadily on side walls 13 of lower plate 2, and thus the rear portion of said adjustable means with groove 8 is lifted up. Said adjustable means 7 is supported by the central portion 34, of said support rod, placed between two side walls 13. Central portion 34, of said support rod, can be better visable on FIG. 6. With the position of clamping means shown on FIG. 2, the brush can be taken off from between said lower plate and upper plate. In reference to FIG. 3, brush 1 is held in its rear portion by adjustable groove 8, that is V-shaped and bent downwards in its length to hold brush in two places P. Adjustable groove 6 is V-shaped and bent upwards in its length to support the brush in two places R. For reference, on FIG. 1, we can see adjustable groove 8 bent downwards, and adjustable groove 6 bent upwards in their lengths. Returning to FIG. 3, for adjustable groove 6, the angle between two V-shaped walls should be between about 90° and 150° in the rear portion, it is where the brush is supported. For adjustable groove 8, the angle between two V-shaped walls should be between about 90° and 150° in the whole length of said adjustable groove. This design of supporting the brush by V-shaped, adjustable groove 6, and holding it by V-shaped, adjustable groove 8 guarantees a very good, steady holding of brush. Two blocking bents 35, extending perpendicularly from said two side walls of upper plate, are provided to limit rotational motion of said upper plate in the upper direction when they touch two blocking heads 36 of said support rod.

Figure 6:
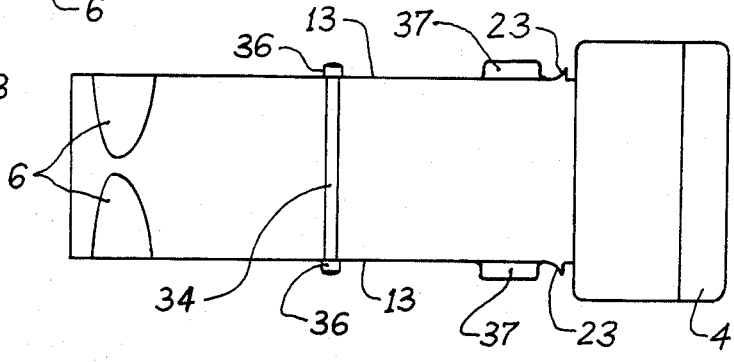
FIG. 6 is an upper view of a lower plate with a support rod.

In reference to FIG. 6, we can see two mounting portions 37, that are bent to the outside in the front portions of two side walls of lower plate. In each of said mounting portions there is a hole for placing said rivet 9.

Figure 7:
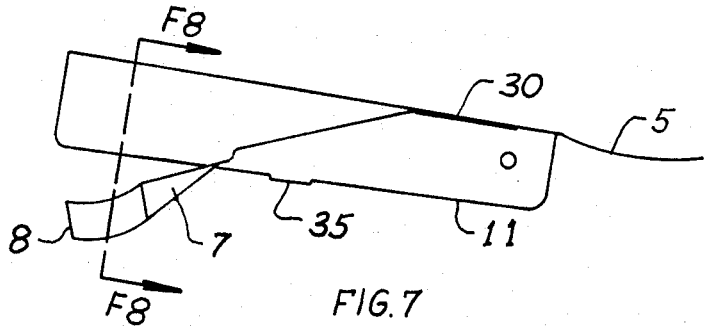
FIG. 7 is a cross sectional view through the center of the upper plate with adjustable means.
Figure 8:
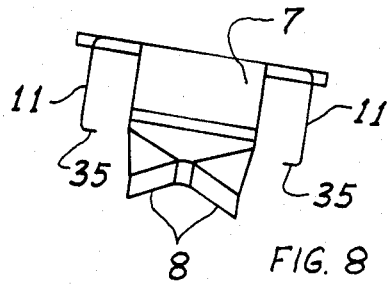
FIG. 8 is a cross sectional view through the rear portion of upper plate with adjustable means in plane shown on FIG. 7, and in the direction shown on FIG. 7 by arrows F8.

In reference to FIG. 7, adjustable means 7 is here in loose position, ie., when it does not exert pressure on the brush.

Figure 9:
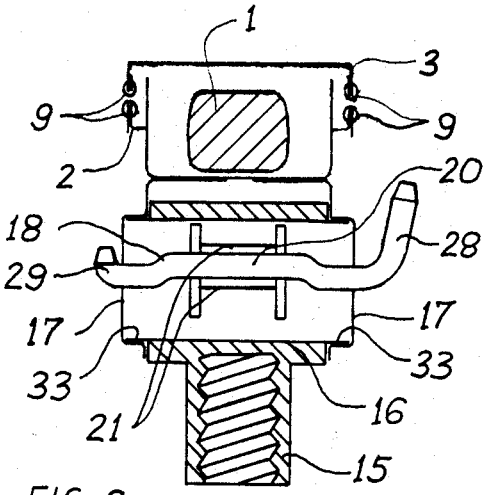
FIG. 9 is a cross sectional view through the attachment with a brush in planes from A to B and from C to D, shown on FIG. 1, and in the direction shown on FIG. 1 by arrows F9. The rear part of upper plate with adjustable means, and the rear part of lower plate are not shown here.
Figure 10:
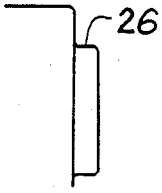
FIG. 10 is a side view of the side plate.
Figure 11:
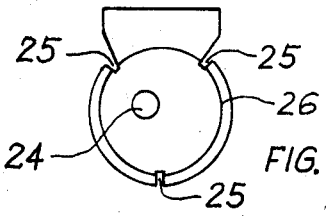
FIG. 11 is a front view of the side plate.
Figure 12:
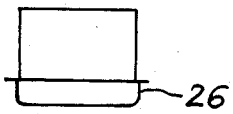
FIG. 12 is an upper view of the side plate.
Figure 13:
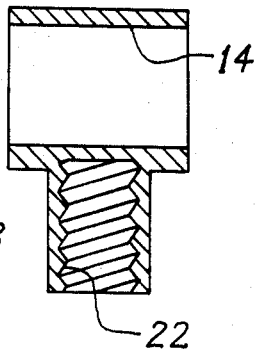
FIG. 13 is a cross sectional view through the center of holding arm being in the same position as in FIG. 9.
Figure 14:
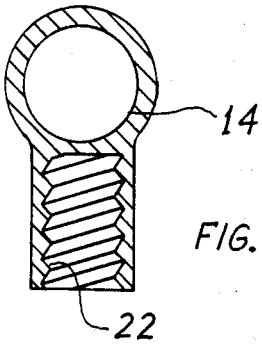
FIG. 14 is a cross section through the center of holding arm and being in the same position as on FIG. 1.

In reference to FIG. 9 the upper plate 3 is rotationally mounted on the lower plate 2 by two rivets 9, and said lower plate is steadily connected to two side plates 17. Two side plates 17 are steadily connected to rotational tube 16, on its two circular edges 33. Clamping lever 18 with its eccentric portion 20, seen here in perspective view, is working on said two clamping bents 21, of rotational tube 16, and thus it is clamping rotational tube 16 to said hole of holding arm 15. Clamping lever 18 is rotationally mounted on two holes 24 of two side plates 17. Eccentric portion 20 is located between said two side plates, actuating arm 28 is on the outside of one of said side plates, and bent 29 is on the outside of the other of said side plates. Side plate 17 is shown on FIG. 11. Three cuts 25 on circular side 26 are made for easy assembly and steady connection, preferably by pressure welding, of said circular side to rotational tube 16.

Figure 15:
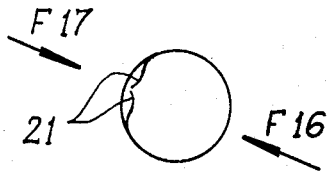
FIG. 15 is a view of a rotational tube being in the same position as on FIG. 1.
Figure 16:
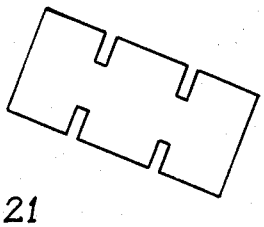
FIG. 16 is a view of the rotational tube in the direction shown by arrow F16 on FIG. 15.

FIG. 15 shows the circular shape of rotational tube 16 with two clamping bents 21.

Figure 17:
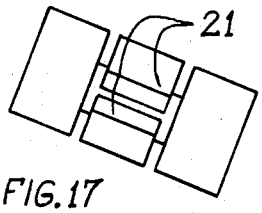
FIG. 17 is a view of the rotational tube in the direction shown by arrow F17 on FIG. 15.

FIG. 17 shows two clamping bents 21, formed in the central portion of said rotational tube, that are formed from partially cut, a circular portion of the rotational tube, and are extending substantially toward the inside of said circular tube.

Figure 19:
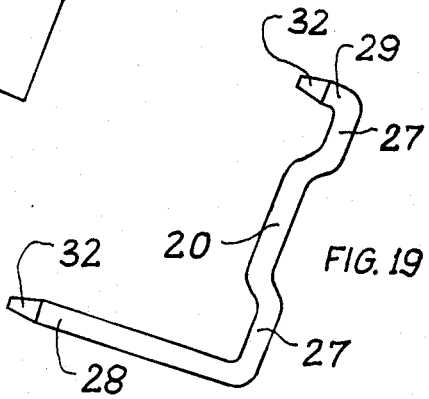
FIG. 19 is a view of clamping lever in the direction shown by arrow F19 on FIG. 18.
Figure 18:
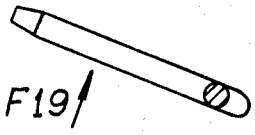
FIG. 18 is a view of a clamping lever and being in the same position as on FIG. 1.
Figure 20:
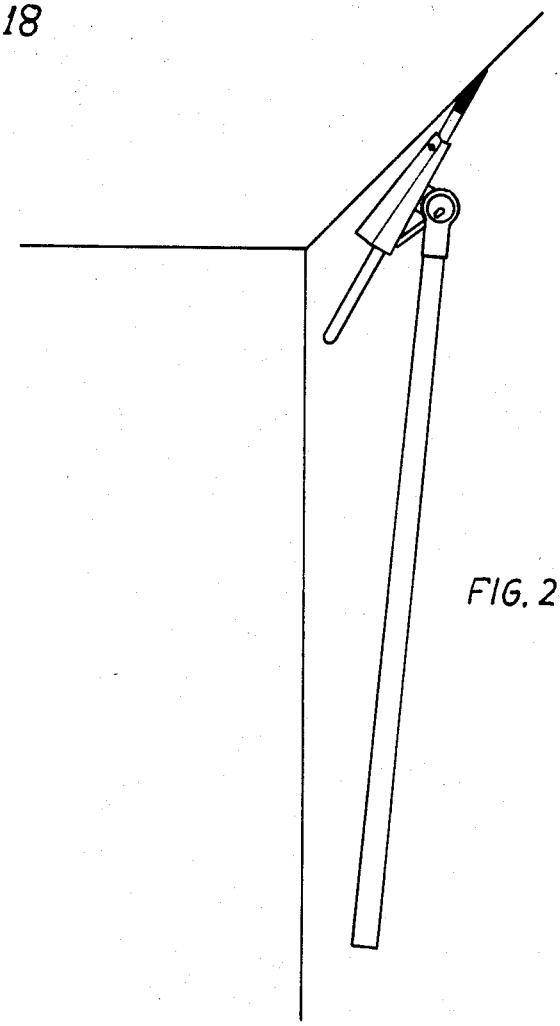
FIG. 20 is a view of the attachment of the invention with a brush and an extension rod being used to paint an upper corner of a wall.

In reference to FIG. 19 a clamping lever 18 is shown with its eccentric portion 20, two pivoting portions 27, actuating arm 28, bent 29, and two coned portions 32. Actuating arm 28, and bent 29, are substantially meant to be formed by bending, after rotationally mounting of said clamping lever on two holes 24 of two side plates 17. For reference we can see FIG. 9 and FIG. 11. The above described lower plate, upper plate, two side plates, rotational tube, and the clamping lever, are to be made out of light metal. Said holding arm is to be made out of light metal, or plastic material.

I claim:

1. An adjustable attachment for holding a brush and substantially provided for use therewith, comprising a longitudinally extending lower plate, said lower plate having a rear portion located away from said brush and a front portion adjacent said brush, said lower plate having an adjustable groove at its rear portion, an upwardly bent arc at its front portion, and two side walls extending upwardly from said rear portion, each of said two side walls having an outwardly extending bent portion in its front portion for supporting a brush in the longitudinal direction, a longitudinally extending upper plate having a front portion adjacent said brush, said upper plate having a downwardly bent arc at its front portion, and two side walls extending downwardly from its upper portion, said upper plate having an adjustable means for holding a brush, and pivot means on the front portions of each of said plates whereby said upper plate is rotationally mounted on said lower plate for clamping said brush between said plates.

2. For use with an adjustable attachment for holding a brush between a lower plate and an upper plate pivotally mounted to said lower plate, and substantially provided for use therewith, a holding arm comprising means on one end for connecting an extension rod thereto and a transversely aligned cylindrical hole on the opposite end thereof, a cylindrical tube rotationally mounted within said hole and having circular edges extending beyond the ends of said hole, said tube having two clamping bent portions biased toward the center of said hole, two side plates, each said side plate encompassing each circular edge of said tube and extending upwardly therefrom and being connected to said lower plate, a hole in each of said side plates, a clamping lever mounted rotationally in each of said two holes of said side plates and an eccentric portion on said clamping lever, whereby when said lever is rotated, the eccentric portion will press against the two clamping bent portions and force the tube against the wall of the cylindrical hole so that the rotational angle of the brush can be adjusted.

3. An adjustable attachment as defined in claim 1 wherein each of said two side walls of said upper plate has a blocking bent in its central lower portion, each bent extends perpendicularly from one side wall of said upper plate toward the inside of said upper plate, and said lower plate has a support rod mounted on its side walls, said support rod is circular in perpendicular cross section, in its whole length, and has two blocking heads extending to the outside of each of said two side walls, and being provided for supporting and releasing said adjustable means by its central portion, placed between said two side walls, and for limiting rotational motion of the upper plate in the upper direction by its two blocking heads interfering with said two blocking bents of upper plate.

4. An adjustable attachment as defined in claim 1 wherein said upper portion of upper plate is planar in vicinity to two side walls of said upper plate.

5. An adjustable attachment as defined in claim 1 wherein said adjustable means is mounted steadily to the inside of said upper portion of said upper plate.

6. An adjustable attachment as defined in claim 1 wherein said adjustable means is a spring means.

7. An adjustable attachment as defined in claim 1 wherein said adjustable means has an adjustable groove at its lower rear portion, said adjustable groove is bent upwards in its length, and has the shape of letter V with an angle of between about 90° and 150° between its two walls in a perpendicular cross section.

8. An adjustable attachment as defined in claim 1 wherein said rotational mounting of said upper plate on said lower plate is by means of two rivets in the front portion of said side walls of said lower plate and the front upper portion of said side walls of said upper plate, and said front portion of side walls of said lower plate is bent to the outside.

9. An adjustable attachment as defined in claim 1 wherein said said lower plate is substantially planar in its central portion, and said adjustable groove at its rear portion is bent upwards in its length, and has the shape of letter V with an angle of between about 90° and 150° between its two walls in perpendicular cross section, in the rear portion of said groove.

10. A holding arm as defined in claim 2 wherein said two side plates are steadily mounted to said lower plate in its central portion.

11. A holding arm as defined in claim 2 wherein said two clamping bents are between two circular edges, in the central portion of said rotational tube.

12. A holding arm as defined in claim 2 wherein said two clamping bents are substantially running toward the inside of said rotational tube.

13. A holding arm as defined in claim 2 wherein said two clamping bents are two spring bents.

14. A holding arm as defined in claim 2 wherein said eccentric portion of said clamping lever is between said two side plates.

15. A holding arm as defined in claim 2 wherein said clamping lever has an actuating arm on the outside of one of said two side plates, and said clamping lever has a bent on the outside of the other of said two side plates.

16. A holding arm as defined in claim 2 wherein said clamping lever is circular in perpendicular cross section, in its whole length.

17. A holding arm as defined in claim 2 wherein said holding arm has a threaded portion at its bottom.

18. An adjustable attachment as defined in claim 1 in combination with said brush.

19. A holding arm as defined in claim 2 in combination with an extension rod mounted to said holding arm.

* * * * *